US005113903A

United States Patent [19]

Dörr

[11] Patent Number: 5,113,903

[45] Date of Patent: May 19, 1992

[54] STEAM CONVERTING VALVE WITH SPINDLE ACTUATION

[75] Inventor: Hermann Dörr, Herzogenaurach, Fed. Rep. of Germany

[73] Assignee: Siemens Aktiengesellschaft, Munich, Fed. Rep. of Germany

[21] Appl. No.: 768,367

[22] Filed: Sep. 27, 1991

[30] Foreign Application Priority Data

Sep. 29, 1990 [DE] Fed. Rep. of Germany ..... 4030902
Dec. 19, 1990 [DE] Fed. Rep. of Germany ..... 4040736

[51] Int. Cl.[5] ..... F16K 11/22

[52] U.S. Cl. ..... 137/556; 137/630.15; 137/898

[58] Field of Search ..... 137/556, 599.2, 630.13, 137/630.14, 630.15, 630, 898

[56] References Cited

U.S. PATENT DOCUMENTS

| | | | |
|---|---|---|---|
| 1,217,726 | 2/1917 | Eckenroth . | |
| 2,160,657 | 5/1939 | Haynes . | |
| 2,213,488 | 9/1940 | Dowrick | 137/630.15 |
| 3,580,288 | 5/1971 | Schuder | 137/630.13 |
| 4,041,979 | 8/1977 | Grotloh | 137/599.2 |
| 4,375,821 | 3/1983 | Nanao . | |
| 4,834,133 | 5/1989 | LaCoste et al. . | |

FOREIGN PATENT DOCUMENTS

| | | |
|---|---|---|
| 1144984 | 3/1963 | Fed. Rep. of Germany . |
| 1916876 | 8/1974 | Fed. Rep. of Germany . |
| 2123163 | 7/1979 | Fed. Rep. of Germany . |
| 3300752 | 7/1984 | Fed. Rep. of Germany . |
| 3304523 | 8/1984 | Fed. Rep. of Germany . |
| 2830609 | 9/1984 | Fed. Rep. of Germany . |
| 3525141 | 7/1988 | Fed. Rep. of Germany . |
| 672462 | 4/1929 | France . |

*Primary Examiner*—Robert G. Nilson
*Attorney, Agent, or Firm*—Herbert L. Lerner; Laurence A. Greenberg

[57] ABSTRACT

A steam converting valve having spindle actuation includes a main valve a main seat and a main throttle body cooperating with the main valve seat for controlling a main steam flow. A common spindle actuator supplies thrust forces. A main spindle is associated with the main valve for transmitting the thrust forces to the main throttle body for opening and closing the main valve. An auxiliary valve has an auxiliary valve seat and an auxiliary throttle body cooperating with the auxiliary valve seat for controlling an atomizer steam flow. An auxiliary spindle is associated with the auxiliary valve for transmitting the thrust forces to the auxiliary throttle body for opening and closing the auxiliary valve. First and second spring elastic couplings respectively transmit the thrust forces for the main spindle and the auxiliary spindle to the main and the auxiliary throttle bodies. The main and auxiliary spindles are adapted to one another for causing the main throttle body to close before the auxiliary throttle body reaches the auxiliary valve seat, so that the main stream flow is blocked off upstream of the atomizer steam flow in a closing operation, and for causing the auxiliary throttle body to open the auxiliary valve before the main throttle body leaves the main valve seat, so that the atomizer steam flow develops upstream of the main steam flow in an opening operation.

27 Claims, 2 Drawing Sheets

STEAM CONVERTING VALVE WITH SPINDLE ACTUATION

Figure 1:
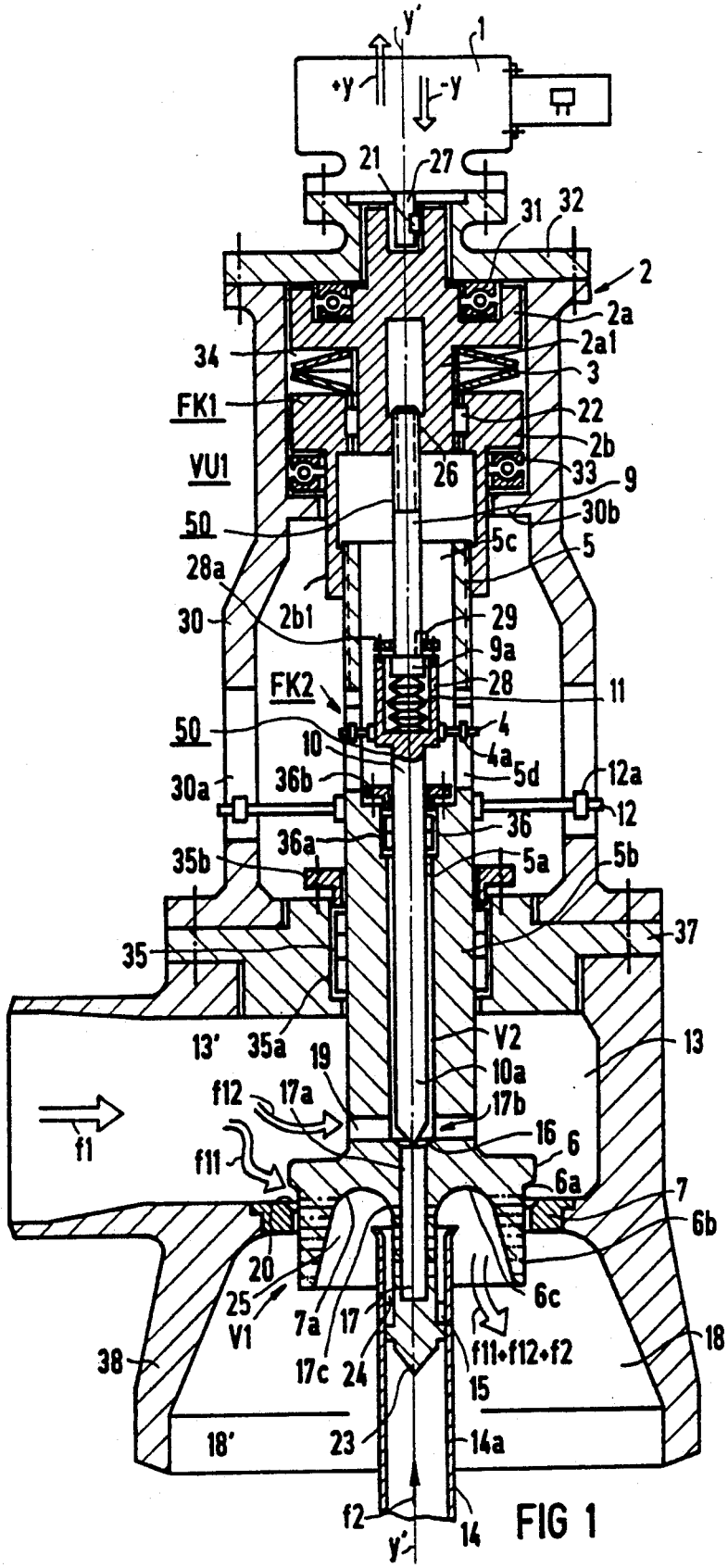

The invention relates to a steam converting or combined pressure-reducing and desuperheating valve with spindle actuation for a main valve and an auxiliary valve.

It is known from process and power plant technology that satisfactory results cannot always be attained in conventional steam converting plants. That is particularly true in the low-load range or when large quantities of coolant are delivered, in order to attain steam temperatures in the vicinity of the saturated steam temperature. The reasons for the lack of optimal operating results are often an inadequate atomization of the coolant and/or a lack of optimal introduction of the coolant into the main steam flow.

It is accordingly an object of the invention to provide a steam converting valve with spindle actuation, which overcomes the hereinafore-mentioned disadvantages of the heretofore-known devices of this general type, specifically by precise control at the correct time of a main throttle body for the main steam flow by means of a main spindle, and of an auxiliary throttle body for the atomizer steam flow by means of an auxiliary spindle. Another object is to create structural preconditions permitting the steam converting valve, in a compact model, to be actuated with both a rotary actuator and a linear actuator, without having to make basic changes in the valve housing, throttle bodies and spindles.

With the foregoing and other objects in view there is provided, in accordance with the invention, a steam converting or combined pressure-reducing and desuperheating valve having spindle actuation for a main and an auxiliary valve, comprising a main valve having a main valve seat and a main throttle body cooperating with the main valve seat for controlling a main steam flow, a common spindle actuator supplying thrust forces, a main spindle associated with the main valve for transmitting the thrust forces to the main throttle body for opening and closing the main valve; an auxiliary valve having an auxiliary valve seat and an auxiliary throttle body cooperating with the auxiliary valve seat for controlling an atomizer steam flow, an auxiliary spindle associated with the auxiliary valve for transmitting the thrust forces to the auxiliary throttle body for opening and closing the auxiliary valve; first and second spring elastic couplings for respectively transmitting the thrust or adjusting forces for the main spindle and the auxiliary spindle to the main and the auxiliary throttle bodies; and the main and auxiliary spindles having means or being adapted to one another for causing the main throttle body to close before the auxiliary throttle body reaches the auxiliary valve seat, so that the main steam flow is blocked off upstream of the atomizer steam flow in a closing operation, and for causing the auxiliary throttle body to open the auxiliary valve before the main throttle body leaves the main valve seat, so that the atomizer steam flow develops upstream of the main steam flow in an opening operation.

The advantages attained with the invention are above all that control at the correct time of the atomizer flow and the main steam flow becomes possible in a steam converting valve, through the use of two separate valve spindles, an auxiliary spindle and a main spindle, while using only a single actuator. Particularly effective steam converting is attained by introducing the atomizer steam concentrically into the coolant flow. The main and auxiliary spindles can then be controlled for steam pressure reduction at the correct time by a single actuator. In the opening direction, only the auxiliary spindle is actuated at first, and the steam flowing as a result is introduced concentrically into the coolant flow to atomize it through a nozzle tube. It is not until after that occurs that the main spindle is lifted from its seat. In the closing direction, the main spindle is first moved to the terminal position, and it is only after that occurs that the auxiliary spindle is actuated, in order to interrupt the atomizer steam flow.

In accordance with another feature of the invention, the main throttle body has a jacket wall and bottom portions being profiled in curved fashion, the main throttle body has an interior with an annular deflection chamber oriented toward the outflow side of the steam for deflecting steam-atomized coolant by substantially 180°, and the chamber is penetrated centrally by the nozzle tube and defined by the jacket wall and bottom portions.

In accordance with a further feature of the invention, the jacket wall portion has an inner periphery extending obliquely inward at an acute angle relative to a valve axis and changing into a curved region near a bottom, which in turn changes into an outer periphery of the nozzle tube with a curvature becoming spirally smaller.

It is therefore seen that in or under the main throttle body, the steam-atomized coolant undergoes a 180° deflection, and as a result is introduced with optimal distribution into the main steam flow without directly reaching the walls of the fixtures or pipelines.

In accordance with an added feature of the invention, there is provided a steam inflow side and an outflow side; the outflow side having a low-pressure chamber, a stationary coolant entry tube disposed in the low-pressure chamber, the main throttle body having a nozzle tube plunging into the coolant entry tube for introducing the atomizer steam flow; the nozzle tube having an axial nozzle tube conduit with a steam inlet forming the auxiliary valve seat, atomizer steam delivery conduits having inlet ends being open to the steam inflow side and outlet ends leading to the steam inlet; and the auxiliary valve seat defining a flow cross section for a connection between the outlet ends of the atomizer steam delivery conduits and the nozzle tube conduit, for closing the connection of the atomizer steam delivery conduits when the auxiliary valve is closed and opening the connection of the atomizer steam delivery conduits when the auxiliary valve open.

In accordance with an additional feature of the invention, the coolant entry tube has an entry tube wall, the nozzle tube has an end plunging into the coolant entry tube, and there is provided a conical body disposed on the end of the nozzle tube for guiding a flow of inflowing coolant to the entry tube wall, the conical body defining an annular conduit for coolant adjoining the conical body at a coolant outflow side, and vortex vanes disposed at an annular conduit for generating a vortex coolant flow. In this way, the coolant is imparted a vortex motion prior to being atomized, so that even when the steam converting valve is installed horizontally, the most symmetrical possible introduction of water is maintained.

In accordance with still another feature of the invention, the nozzle body is a tube coupling disposed centrally on and protruding axially from the outflow side of the main throttle body.

In order to attain a concentric, compact structure, in accordance with yet another feature of the invention, the main spindle has a central conduit defining a transitional region from the central conduit to the axial nozzle tube conduit, the auxiliary throttle body is a tappet, the tube coupling of the nozzle tube forms a coaxial extension of the central conduit in which the auxiliary throttle body is longitudinally displaceably and sealingly supported, and the auxiliary valve seat, in particular having conical seat surfaces, is disposed in the transitional region.

In accordance with yet a further feature of the invention, the main throttle body is movable between closing terminal, closing, intermediate and open terminal positions; the main throttle body has an axial length, seat surfaces and an outer periphery with a cylindrical jacket wall extending from the seat surfaces toward the low-pressure chamber; the jacket wall having a plurality of inlet conduits for the main steam flow being distributed over the periphery and the axial length (perforated throttle body), none of the inlet conduits being open in the closing position and in the closing terminal position of the main throttle body, all of the inlet conduits being open in the open terminal position, and a stroke-dependent percentage of the inlet conduits being open in the intermediate positions.

In accordance with yet an added feature of the invention, the nozzle body has a plurality of axially and circumferentially distributed nozzle bores for injecting the atomizer steam flow into the coolant flow.

The special embodiment of the first and second spring-elastic couplings and of a linear and rotary actuator are discussed below in the form of a spindle actuator that is common to both valve spindles, that is to both the main spindle and the auxiliary spindle.

In accordance with yet an additional feature of the invention, there is provided a drive member through which the common spindle actuator moves the main and auxiliary spindles, the drive member being coupled to the main spindle through the first spring-elastic coupling and to the auxiliary spindle through the second spring-elastic coupling.

In accordance with again another feature of the invention, there is provided a length adjusting device for the auxiliary spindle being inserted between the drive member and the second spring-elastic coupling.

In accordance with again a further feature of the invention, the main spindle has a central conduit for the auxiliary throttle body and a shaft part adjoining the main throttle body with a widened hollow chamber adjoining the central conduit, and the auxiliary spindle is movable with the second spring-elastic coupling in a reciprocation direction inside the hollow chamber.

In accordance with again an added feature of the invention, the auxiliary spindle has a lower part and an upper part with a reinforced cap part, the second spring-elastic coupling has a spring basket with a basket lid and a prestressed compression spring assembly, in particular a cup spring assembly, the spring basket is seated on the lower part and the reinforced cap part longitudinally displaceably supports the upper part, is loaded by the compression spring assembly inside the spring basket and is caught by the basket lid.

In accordance with again an additional feature of the invention, there is provided a valve yoke having a peripheral wall with longitudinal slits formed therein, the main spindle having laterally protruding roller arms in the longitudinal slits guiding the main spindle or the shaft part thereof in a reciprocation direction for torsionally securing the main spindle and indicating a stroke of the main spindle.

In accordance with still another feature of the invention, a maximum stroke is provided being approximately equivalent to half a spring deflection travel of the first spring-elastic coupling of the main spindle, when the first spring-elastic coupling is not yet pressed in.

In accordance with still a further feature of the invention, the spindle actuator is a linear actuator, and there is provided a drive member in the form of piston rod being coupled to the linear actuator, a drive rod being coupled to the piston rod and having an annular flange, the first spring-elastic coupling having a spring basket with a basket housing, a basket bottom, a housing cap, and a prestressed compression spring supported in the basket housing, the compression spring having one end supported at on the basket bottom and another end supported on the annular flange, the annular flange being caught in the basket housing by the housing cap.

In accordance with still an added feature of the invention, the compression spring is a prestressed cup spring assembly.

In accordance with still an additional feature of the invention, the linear actuator is a hydraulic piston/cylinder system.

In accordance with another feature of the invention, the spindle actuator is a rotary actuator having a spindle nut assembly being rotatable by the rotary actuator for imparting a motion in a reciprocation direction to both the main spindle and the auxiliary spindle, the first spring-elastic coupling assigned to the main spindle and the second spring-elastic coupling assigned to the auxiliary spindle enabling a relative axial motion of the main and auxiliary spindles.

In accordance with a further feature of the invention, the spindle nut assembly has first and second spindle nuts being axially spaced apart defining an axial interspace therebetween; the first spindle nut being joined to and fixed against rotation relative to the spindle actuator, the first spindle nut having an internal thread forming a screw bearing for torsionally secured axial motion of the auxiliary spindle, and the first spindle nut having a guide shaft; the second spindle nut being supported and fixed against relative rotation, but axially displaceable on the guide shaft; the first spring-elastic coupling being inserted in the axial interspace; and the second spindle nut having a threaded shaft forming a screw bearing for torsionally secured axial motion of the main spindle.

In accordance with an added feature of the invention, the first spring-elastic coupling is a prestressed compression spring assembly, in particular a prestressed cup spring assembly.

In accordance with an additional feature of the invention, the auxiliary spindle is screw-supported in the first spindle nut, the main spindle is screw-supported in the second spindle nut, and the thread pitches of the first spindle nut and of the auxiliary spindle are equal to the thread pitches of the second spindle nut and of the main spindle.

In accordance with a concomitant feature of the invention, the auxiliary spindle has a lower part, and there is provided a gland in an end region of the central conduit sealingly and slidingly guiding the lower part and the auxiliary throttle body.

Other features which are considered as characteristic for the invention are set forth in the appended claims.

Although the invention is illustrated and described herein as embodied in a steam converting valve with spindle actuation, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 2:
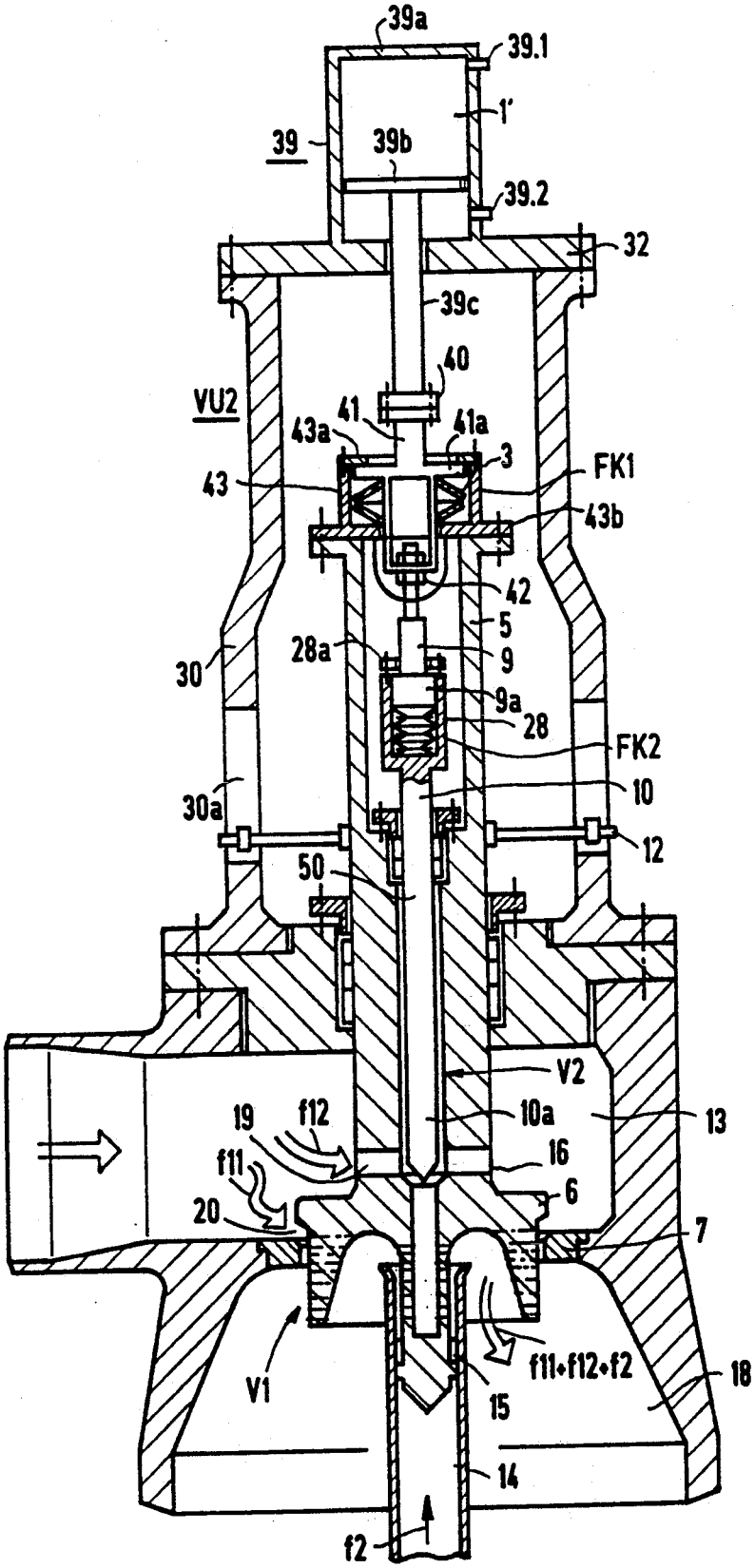

FIG. 1 is a diagrammatic, axial-sectional view taken through a valve housing of a first exemplary embodiment of a steam converting valve according to the invention with a rotary actuator; and FIG. 2 is a view similar to FIG. 1 of a second exemplary embodiment of a steam converting valve according to the invention, having a linear actuator.

Referring now to the figures of the drawing in detail and first, particularly, to FIG. 1 thereof, there is seen a basic structure of a steam converting valve VU1 according to the invention. In order to provide steam converting, work is performed with a double-spindle-controlled steam pressure reduction and steam-atomized coolant. The steam converting valve VU1 includes a main valve V1, which is combined with an auxiliary valve V2.

A rotary actuator 1 actuates a main spindle 5 having a main throttle body 6 through a split spindle nut assembly 2, which is constructed in such a way as to be torsion-resistant as a result of spring wedges 21, 22. The spindle nut assembly includes a first spindle nut 2*a* and a second spindle nut 2*b*. In a closed state, a sealing surface 6*a* of the main throttle body 6 is pressed upon a valve seat 7, or in other words on corresponding seat surfaces 7*a*. Inserted between the first (upper) spindle nut 2*a* and the second (lower) spindle nut 2*b* is a prestressed compression spring assembly 3, which is a first cup spring or cup spring package in a preferred embodiment. For the sake of simplicity, only one (first) cup spring 3 will therefore be discussed below. An upper part 9 of an auxiliary spindle 50 is screwed directly into the first spindle nut 2*a*. The thread pitch of the upper part 9 of the auxiliary spindle in the first spindle nut 2*a* is precisely equivalent to the thread pitch of the main spindle 5 in the second spindle nut 2*b*. The first and second spindle nuts 2*a*, 2*b* and the prestressed cup spring 3 introduced between them form a first spring-elastic coupling FK1. A second spring-elastic coupling FK2, in the form of a coupling piece having a prestressed cup spring package 11, is introduced between the upper part 9 and a lower part 10 of the auxiliary spindle 50. The coupling piece FK2 joins the two auxiliary spindle parts 9, 10 to one another in a torsionally secured manner. The prestressed cup spring packet 11 will simply be referred to below as the second cup spring, although in principle it too may be a prestressed compression spring or helical compression spring assembly. Stroke position display and torsional securing means 12 are located on the main spindle 5. The auxiliary spindle 50 is equipped with torsional securing means 4 relative to the main spindle 5, which can also serve as a stroke position indicator if needed, for instance for monitoring purposes.

The auxiliary valve, which is identified as a whole by reference symbol V2, is disposed and supported coaxially and centrally with respect to the main spindle 5 with its auxiliary spindle 50 and an auxiliary throttle body 10*a* thereof that forms a part of the lower part 10 of the spindle 50. An outlet of an auxiliary seat 16 for the auxiliary throttle body 10*a*, which is located inside the main throttle body 6, discharges into a nozzle tube 17, which protrudes into a coolant entry tube 14. An entry side of the auxiliary seat 16 communicates with a high-pressure chamber 13 of the steam converting valve VU1 through atomizer steam delivery conduits 19 that are constructed as radial bores. The high-pressure chamber 13 is located on an inflow side 13, of the valve VU1.

Presetting of the auxiliary spindle 50 is performed in such a way that with the first cup spring 3 stretched (that is with a position of the main spindle 5 greater than 0%), with the torsional securing means 4 loosened, and by rotation of the auxiliary spindle 50 through its upper and lower parts 9, 10, a maximum stroke (a spacing between the auxiliary seat 16 and the auxiliary spindle 50) of the auxiliary spindle 50 is set, which is approximately equivalent to half the spring deflection travel of the first cup spring 3.

The function of the valve VU1 in the closing direction will be described below. The starting situation is assumed to be that the rotary actuator 1, the main spindle 5 and the main throttle body 6 are in the open position or in an intermediate position. The prestressed cup springs 3 and 11 are stretched. The auxiliary spindle 50 has assumed the preset maximum stroke, which means that the inflow side 13' communicates with an outflow side 18, having a low-pressure chamber 18, through the delivery conduits 19 and the nozzle tube 17. The atomizer steam flow f12 can then flow out from the inflow side 13' through the inflow conduits 19, the (open) auxiliary seat 16 and free nozzle bores 17*c* of the nozzle tube 17, while atomizing a coolant flow f2 through the coolant entry tube 14, into the low-pressure chamber 18. A main steam flow f11 flows from the inflow side 13, through inlet conduits 20 in the form of a plurality of radially oriented bores in the main throttle body 6, into the low-pressure chamber 18. In the main throttle body 6 or immediately below it, an intensive mixing of the main steam flow f11 with the steam-atomized coolant takes place, which is brought about by mixing the atomizer steam flow f12 with the coolant flow f2, resulting in a converted steam flow f11+f12+f2, as shown by arrows indicating the corresponding flows. A total quantity of inflowing steam, which is represented by reference symbol f1, splits into the main steam flow f11 and the atomizer steam flow f12.

If the rotary actuator 1 then moves the main spindle 5 with the main throttle body 6 in a closing direction −y by rotation of the spindle nut assembly 2 (the opening direction is indicated as +y, and the axis of the valve VU1 is indicated as y'-y'), then the position of the auxiliary spindle 50 relative to the main spindle 5 is maintained until a closed terminal position is attained, or in other words until the main throttle body 6 is seated on the valve seat 7. This means that the atomizer steam flow f12 through the auxiliary seat 16 and the nozzle tube 17 is maintained fully until a closed terminal position of the main throttle body 6.

It is not until spring deflection of the first cup springs 3, or in other words the upward motion of the second spindle nut 2*b*, that the lower part 10 of the auxiliary spindle is moved in the direction of the auxiliary seat 16, until finally, at half the spring deflection travel of the cup spring 3, the lower part 10 of the auxiliary spindle is pressed firmly against the auxiliary seat 16, which also blocks the atomizer steam flow f12. Upon further compression of the cup spring 3, the prestressed second cup springs 11 are then compressed as well. The lower part 10 of the auxiliary spindle is pressed into the auxiliary seat 16 with the spring force of the cup springs 11, and as a result an absolutely tightly closing terminal position is attained.

In order to describe the function in the opening direction, the tightly closing state of the valve is assumed as a starting situation. As soon as the rotary actuator 1 moves in the opening direction +y, the relaxation of the cup springs 3 and 11 begins. Once the cup spring 3 is approximately halfway relaxed, the lower part 10 of the auxiliary spindle begins to lift away from the auxiliary seat 16, and continuously opens the communication between the inflow side 13' to the outflow side 18' through the nozzle tube 17, as a result of which the atomizer steam flow f12 is brought to the maximum intensity, which is dependent on the pressure drop. The full atomizer steam quantity is then already available for the coolant f2 flowing in through the coolant entry tube 14, with this coolant being set into a swirling motion through vortex vanes or deflection fins 15 mounted on the nozzle tube 17. It is not until the cup spring 3 is completely stretched that the opening motion of the main spindle 5 with the main throttle body 6, and thus the flow of the main steam flow f11, begin.

It is apparent from the above description that the steam converting valve VU1 of FIG. 1 (and correspondingly the valve VU2 of FIG. 2 as well) has a spindle actuator for one main valve V1 and for one auxiliary valve V2. The main valve V1 of the steam converting valve VU1 has the main throttle body 6 to control the main steam flow f11. In order to open and close the main valve V1, the thrust forces of the spindle actuator 1 (which is a rotary actuator in FIG. 1) can be transmitted from the associated main spindle 5 to the main throttle body 6. The steam converting valve VU1 also includes the auxiliary valve V2, which has the auxiliary throttle body 10*a* for controlling the atomizer steam flow f12. In order to open and close the auxiliary valve V2, the thrust forces of the spindle actuator 1 can be transmitted from the associated auxiliary spindle 50 to the auxiliary throttle body 10*a*. The control forces of the common spindle actuator 1 for the main and auxiliary spindles 5, 50 can each be transmitted through respective first and second spring-elastic couplings 3 and 11 to the main throttle body 6 and the auxiliary throttle body 10*a*. The two spindles 5, 50 are adapted to one another in such a way that during the closing operation the main throttle body 6 closes before the auxiliary throttle body 10*a* reaches its auxiliary valve seat 16, and therefore the main steam flow f11 is blocked off upstream of the atomizer steam flow f12. The adaptation is also provided in such a way that during the opening operation the auxiliary throttle body 10*a* opens its auxiliary valve V2 before the main throttle body 6 leaves its main valve seat 7, so that the atomizer steam flow f12 develops upstream of the main steam flow f11. The structural details described below are particularly advantageous for achieving the above-described mode of operation. The coolant entry tube 14 disposed in the low-pressure chamber 18 on the outflow side 18' is stationary. The coolant quantity is adjustable to desired values by a non-illustrated coolant adjusting fixture. The nozzle tube 17 of the main throttle body 6, which serves to introduce the atomizer steam flow f12, plunges into the coolant entry tube 14. A steam inlet 17*b* of an axial nozzle tube conduit 17*a* forms the auxiliary valve seat 16 for the auxiliary throttle body 10*a*. Leading to this steam inlet 17*b* are the atomizer steam delivery conduits 19, which have an inlet side open toward the inflow side or high-pressure chamber 13 of the valve VU1. The auxiliary valve seat 16 defines the flow cross section for a connection between the outlet ends of the atomizer steam delivery conduits 19 and the nozzle tube conduit 17*a*, so that the connection of the delivery conduits 19, when the auxiliary valve V2 is closed or open, is likewise respectively closed or open.

The main throttle body 6, which has a substantially hollowcylindrical shape, has a jacket wall 6*b* that is cylindrical on its outer periphery and extends from its sealing or seat surfaces 6*a* toward the low-pressure chamber 18. As can be seen, the jacket wall 6*b* is a so-called perforated throttle body which is provided with a plurality of the inlet conduits 20 for the main steam f11, that are distributed over its periphery and its axial length. Of these, none are open in the closing position or in the closing terminal position of the main throttle body 6, while in the open terminal position, all of them are open, and in intermediate positions a stroke-dependent percentage thereof are open. The axes of the inlet conduits 20 extend radially relative to the valve axis y'-y', in the example shown.

In order to provide for good mixing of the coolant with the atomizer steam, the end of the nozzle tube 17 plunging into the coolant entry tube 14 is provided with a conical body 23 serving to carry the flow of the inflowing coolant f2 toward an inlet tube wall 14*a*. The vortex vanes or deflection fins 15 for generating a vortex flow of coolant are disposed in an annular conduit 24 adjoining the conical body 23 on the coolant outflow side. As can be seen, the nozzle tube 17 is constructed as a centrally disposed and axially protruding tube coupling on the outflow side 18' of the main throttle body 6. In particular, this tube coupling of the nozzle tube 17 is the coaxial continuation of a central conduit 5*a* of the main spindle 5, in which the auxiliary throttle body 10*a* that is constructed as a tappet and is part of the auxiliary spindle 50, is supported longitudinally displaceably and sealingly. The auxiliary valve seat 16, which in particular has conical seating surfaces for the auxiliary throttle body 10*a*, is disposed in a transition region from the central conduit 5*a* to the axial nozzle tube conduit 17*a*. The nozzle tube 17 is provided with a plurality of the axially and circumferentially distributed nozzles bores 17*c* in order to inject the atomizer steam flow f12 into the coolant flow f2. In the open position of the main throttle body 6, all of these nozzle bores 17*c* are free. In other words, they no longer plunge into the entry tube 14.

In order to deflect the steam-atomized coolant by practically or approximately 180°, the main throttle body 6 has an annular deflection chamber 25 on the inside thereof which is oriented toward the outflow side 18' of the steam. This chamber is centrally penetrated by the nozzle tube 17 and is defined by jacket wall and bottom portions 6*c* of the main throttle body 6, that are profiled in a curved fashion. In particular, as shown, the inner periphery of the jacket wall portion initially extends obliquely inward, at an acute angle relative to the valve axis y'-y', and then changes to a curved region near the bottom, which in turn changes with a spirally decreasing curvature into the outer periphery of the nozzle tube 17.

A length adjusting device of the auxiliary spindle 50 is formed by the auxiliary spindle itself when the torsion securing means 4 is loosened, by screwing it farther or less far into a threaded bore 26 in the first spindle nut 2*a*. A common drive member for the main and auxiliary spindles 5, 50 is formed by a shaft journal 27 of the rotary actuator 1. Adjoining the central conduit 5*a* inside one shaft part 5*b* of the main spindle 5, is a widened hollow chamber 5*c*. Inside this hollow chamber 5*c*, the auxiliary spindle 50 is movable with its second spring-elastic coupling FK2 in the reciprocation direction ±y. The second spring-elastic coupling FK2 preferably has a spring basket 28 containing the prestressed cup spring 11. The spring basket 28 is seated on the lower part 10 of the auxiliary spindle, and the upper part 9 of the auxiliary spindle, which has a reinforced cap part 9*a*, is longitudinally displaceably supported and loaded by the cup spring 11 inside the spring basket 28 and is caught by a basket lid 28*a*. A spring wedge indicated at reference numeral 29 is provided for torsional security between the upper part 9 of the spindle and the spring basket 28.

In order to torsionally secure the main spindle 5 and to indicate the stroke, the main spindle 5 or its shaft part 5*b* is guided in the reciprocation direction ±y by the stroke position display and torsional securing means 12, which are laterally protruding roller arms. The roller arms 12 are disposed in longitudinal slits 30*a* formed in a peripheral wall of a valve yoke or bracket 30. Guide rollers are shown at reference numeral 12*a*. The same is true for the tortional securing means 4 which are roller arms having guide rollers 4*a* for the spring basket 28. In this case, guide slits are shown with reference numeral 5*d*.

The first spindle nut 2*a* is rotatably supported by means of a first pressure bearing 31, which is supported in a housing cap 32. The second spindle nut 2*b* is correspondingly rotatably supported by means of a second pressure bearing 33, which is supported on an annular flange 30*b* inside the housing of the valve yoke 30. As can be seen, the first spindle nut 2*a* is joined to the spindle actuator 1 in such a manner as to be fixed against relative rotation, through the use of the shaft journal 27 and the spring wedge 21. With its internally thread bore 26, the first spindle nut 2*a* forms a screw bearing for the torsionally secured auxiliary spindle 50 in order to provide for its axial motion. The second spindle nut 2*b* is supported in such a manner as to be fixed against relative rotation but axially displaceable on a guide shaft 2*a*1 of the first spindle nut 2*a*. The first spring-elastic coupling FK1 is inserted into an axial interspace 34 between the first and second spindle nuts 2*a*, 2*b*. The second spindle nut 2*b* has a threaded shaft 2*b*1, with which it forms a screw bearing for the torsionally secured main spindle 5 in order to provide for its axial motion.

In order to seal off the main spindle duct and the high-pressure chamber 13 from the outside, the shaft part 5*b* of the main spindle 5 is sealed off slidingly by a gland 35 having a gland packing 35*a* and a closure cap 35*b*. Correspondingly, the auxiliary spindle 50 is sealingly guided to the outside by means of a gland 36, and therefore that duct location is also sealed off from the outside. A gland cap 36*b* and a packing 36*a* are also shown. The gland 35 is seated on the inner periphery of an intermediate piece 37 between a valve housing 38 and the valve yoke 30. This intermediate piece 37 serves the purpose of sealing a flanged connection between the valve yoke 30 and the valve housing 38 and forms a precise guide location for the main spindle 5.

In principle, the rotary actuator 1 can be an electric, hydraulic or pneumatic rotary actuator. Preferably it is an electric regulating motor, which receives a control variable corresponding to its set value or command/actual value difference, from a process control system.

A steam converting valve VU2 shown in FIG. 2 has the same structure on the steam and water side as that of FIG. 1, and therefore identical elements are provided with the same reference numerals. Instead of a rotary actuator 1, a hydraulic linear actuator 1' which is provided in this case has a hydraulic piston/cylinder system 39. A cylinder, which is structurally united with the valve housing cap 32, is shown at reference numeral 39*a*, a piston is shown at reference numeral 39*b*, and a piston rod is shown at reference numeral 39*c*. A coupling 40 couples the piston rod 39*c* to a drive rod 41 which is common to both valve spindles, that is to the main spindle 5 and the auxiliary spindle 50. The drive rod 41 is connected through the first spring-elastic coupling FK1 to the main spindle 5 and through a length adjusting device 42 to the upper part 9 of the auxiliary spindle 50. This upper part 9 is coupled to the lower part 10 of the auxiliary spindle through the second spring-elastic coupling FK2. The first spring-elastic coupling FK1 has a spring basket with a housing 43, a housing cap 43*a*, a housing bottom 43*b*, and the prestressed cup spring packet 3 disposed on the inside of the housing 43. A flange 41*a* of the drive rod 41 is caught inside the housing 43 by the mounted and secured housing cap 43*a*. The structure of the second spring-elastic coupling FK2 in FIG. 2 is like that of the first embodiment of FIG. 1, except for the torsional securing means, which is not required in this case. The adjustment of the auxiliary spindle 50 with respect to the main spindle 5 is effected in such a way that when the spring basket of the first spring-elastic coupling FK1 is not pressed in (wherein the position of the main spindle 5 is greater than 0%), a maximum stroke (spacing between the auxiliary seat 16 and the auxiliary spindle 50) of the auxiliary spindle 50 is set by the adjusting device 42. This stroke corresponds to approximately half the spring deflection travel of the first spring-elastic coupling FK1. The course of the opening and closing motions of the main and auxiliary spindles 5, 50 and of the associated throttle bodies 6, 10*a* is logically as already described in conjunction with the first exemplary embodiment, except for a difference which is that due to the hydraulic piston/cylinder system 39 with two connection couplings 39.1 and 39.2 for a hydraulic medium, thrust forces are exerted upon the piston rod 39*c*.

I claim:

1. A steam converting valve having spindle actuation, comprising:

a) a main valve having a main valve seat and a main throttle body cooperating with said main valve seat for controlling a main steam flow, a common spindle actuator supplying thrust forces, a main spindle associated with said main valve for transmitting the thrust forces to said main throttle body for opening and closing said main valve;

b) an auxiliary valve having an auxiliary valve seat and an auxiliary throttle body cooperating with said auxiliary valve seat for controlling an atomizer steam flow, an auxiliary spindle associated with said auxiliary valve for transmitting the thrust forces to said auxiliary throttle body for opening and closing said auxiliary valve;

c) first and second spring elastic couplings for respectively transmitting the thrust forces for said main spindle and said auxiliary spindle to said main and said auxiliary throttle bodies; and d) said main and auxiliary spindles having means for causing said main throttle body to close before said auxiliary throttle body reaches said auxiliary valve seat, so that the main steam flow is blocked off upstream of the atomizer steam flow in a closing operation, and means for causing said auxiliary throttle body to open said auxiliary valve before said main throttle body leaves said main valve seat, so that the atomizer steam flow develops upstream of the main steam flow in an opening operation.

2. The steam converting valve according to claim 1, including a steam inflow side and an outflow side;

said outflow side having a low-pressure chamber, a stationary coolant entry tube disposed in said low-pressure chamber, said main throttle body having a nozzle tube plunging into said coolant entry tube for introducing the atomizer steam flow;

said nozzle tube having an axial nozzle tube conduit with a steam inlet forming said auxiliary valve seat, atomizer steam delivery conduits having inlet ends being open to said steam inflow side and outlet ends leading to said steam inlet; and said auxiliary valve seat defining a flow cross section for a connection between said outlet ends of said atomizer steam delivery conduits and said nozzle tube conduit, for closing said connection of said atomizer steam delivery conduits when said auxiliary valve is closed and opening said connection of said atomizer steam delivery conduits when said auxiliary valve open.

3. The steam converting valve according to claim 2, wherein said main throttle body is movable between closing terminal, closing, intermediate and open terminal positions;

said main throttle body has an axial length, seat surfaces and an outer periphery with a cylindrical jacket wall extending from said seat surfaces toward said low-pressure chamber;

said jacket wall having a plurality of inlet conduits for the main steam flow being distributed over said periphery and said axial length, none of said inlet conduits being open in said closing position and in said closing terminal position of said main throttle body, all of said inlet conduits being open in said open terminal position, and a stroke-dependent percentage of said inlet conduits being open in said intermediate positions.

4. The steam converting valve according to claim 2, wherein said coolant entry tube has an entry tube wall, said nozzle tube has an end plunging into said coolant entry tube, and including a conical body disposed on said end of said nozzle tube for guiding a flow of inflowing coolant to said entry tube wall, said conical body defining an annular conduit adjoining said conical body at a coolant outflow side, and vortex vanes disposed at an annular conduit for generating a vortex coolant flow.

5. The steam converting valve according to claim 2, wherein said nozzle body is a tube coupling disposed centrally on and protruding axially from said outflow side of said main throttle body.

6. The steam converting valve according to claim 5, wherein said main spindle has a central conduit defining a transitional region from said central conduit to said axial nozzle tube conduit, said auxiliary throttle body is a tappet, said tube coupling of said nozzle tube forms a coaxial extension of said central conduit in which said auxiliary throttle body is longitudinally displaceably and sealingly supported, and said auxiliary valve seat is disposed in said transitional region.

7. The steam converting valve according to claim 6, wherein said auxiliary valve seat has conical seat surfaces.

8. The steam converting valve according to claim 2, wherein said nozzle body has a plurality of axially and circumferentially distributed nozzle bores for injecting the atomizer steam flow into the coolant flow.

9. The steam converting valve according to claim 2, wherein said main throttle body has a jacket wall and bottom portions being profiled in curved fashion, said main throttle body has an interior with an annular deflection chamber oriented toward said outflow side for deflecting steam-atomized coolant by substantially 180°, and said chamber is penetrated centrally by said nozzle tube and defined by said jacket wall and bottom portions.

10. The steam converting valve according to claim 9, wherein said jacket wall has an inner periphery extending obliquely inward at an acute angle relative to a valve axis and changing into a curved region near a bottom, which in turn changes into an outer periphery of said nozzle tube with a curvature becoming spirally smaller.

11. The steam converting valve according to claim 1, including a drive member through which said common spindle actuator moves said main and auxiliary spindles, said drive member being coupled to said main spindle through said first spring-elastic coupling and to said auxiliary spindle through said second spring-elastic coupling.

12. The steam converting valve according to claim 11, including a length adjusting device for said auxiliary spindle being inserted between said drive member and said second spring-elastic coupling.

13. The steam converting valve according to claim 1, wherein said main spindle has a central conduit for said auxiliary throttle body and a shaft part adjoining said main throttle body with a widened hollow chamber adjoining said central conduit, and said auxiliary spindle is movable with said second spring-elastic coupling in a reciprocation direction inside said hollow chamber.

14. The steam converting valve according to claim 1, wherein said auxiliary spindle has a lower part and an upper part with a reinforced cap part, said second spring-elastic coupling has a spring basket with a basket lid and a prestressed compression spring assembly, said spring basket is seated on said lower part and said reinforced cap part longitudinally displaceably supports said upper part, is loaded by said compression spring assembly inside said spring basket and is caught by said basket lid.

15. The steam converting valve according to claim 14, wherein said prestressed compression spring assembly is a cup spring assembly.

16. The steam converting valve according to claim 1, including a valve yoke having a peripheral wall with longitudinal slits formed therein, said main spindle having laterally protruding roller arms in said longitudinal slits guiding said main spindle in a reciprocation direction for torsionally securing said main spindle and indicating a stroke of said main spindle.

17. The steam converting valve according to claim 13, including a valve yoke having a peripheral wall with longitudinal slits formed therein, said main spindle having laterally protruding roller arms in said longitudinal slits guiding said main spindle in a reciprocation direction for torsionally securing said main spindle and indicating a stroke of said shaft part.

18. The steam converting valve according to claim 1, wherein a maximum stroke is provided being approximately equivalent to half a spring deflection travel of said first spring-elastic coupling of said main spindle, when said first spring-elastic coupling is not yet pressed in.

19. The steam converting valve according to claim 1, wherein said spindle actuator is a linear actuator, and including a drive member in the form of piston rod being coupled to said linear actuator, a drive rod being coupled to said piston rod and having an annular flange, said first spring-elastic coupling having a spring basket with a basket housing, a basket bottom, a housing cap, and a prestressed compression spring supported in said basket housing, said compression spring having one end supported at on said basket bottom and another end supported on said annular flange, said annular flange being caught in said basket housing by said housing cap.

20. The steam converting valve according to claim 19, wherein said compression spring is a prestressed cup spring assembly.

21. The steam converting valve according to claim 19, wherein said linear actuator is a hydraulic piston/-cylinder system.

22. The steam converting valve according to claim 1, wherein said spindle actuator is a rotary actuator having a spindle nut assembly being rotatable by said rotary actuator for imparting a motion in a reciprocation direction to both said main spindle and said auxiliary spindle, said first spring-elastic coupling assigned to said main spindle and said second spring-elastic coupling assigned to said auxiliary spindle enabling a relative axial motion of said main and auxiliary spindles.

23. The steam converting valve according to claim 22, wherein said spindle nut assembly has first and second spindle nuts being axially spaced apart defining an axial interspace therebetween;

said first spindle nut being joined to and fixed against rotation relative to said spindle actuator, said first spindle nut having an internal thread forming a screw bearing for torsionally secured axial motion of said auxiliary spindle, and said first spindle nut having a guide shaft;

said second spindle nut being supported and fixed against relative rotation, but axially displaceable on said guide shaft;

said first spring-elastic coupling being inserted in said axial interspace; and said second spindle nut having a threaded shaft forming a screw bearing for torsionally secured axial motion of said main spindle.

24. The steam converting valve according to claim 23, wherein said first spring-elastic coupling is a prestressed compression spring assembly.

25. The steam converting valve according to claim 24, wherein said prestressed compression spring assembly is a prestressed cup spring assembly.

26. The steam converting valve according to claim 23, wherein said auxiliary spindle is screw-supported in said first spindle nut, said main spindle is screw-supported in said second spindle nut, and the thread pitches of said first spindle nut and of said auxiliary spindle are equal to the thread pitches of said second spindle nut and of said main spindle.

27. The steam converting valve according to claim 6, wherein said auxiliary spindle has a lower part, and including a gland in an end region of said central conduit sealingly and slidingly guiding said lower part and said auxiliary throttle body.

* * * * *